US012286284B1

(12) United States Patent
Liu

(10) Patent No.: US 12,286,284 B1
(45) Date of Patent: Apr. 29, 2025

(54) FACIAL TOWEL PACKAGING BOX

(71) Applicant: Xinwei Liu, Tianjin (CN)

(72) Inventor: Xinwei Liu, Tianjin (CN)

( * ) Notice: Subject to any disclaimer, the term of this patent is extended or adjusted under 35 U.S.C. 154(b) by 0 days.

(21) Appl. No.: 18/922,985

(22) Filed: Oct. 22, 2024

(51) Int. Cl.
*B65D 6/16* (2006.01)
*B65D 83/08* (2006.01)

(52) U.S. Cl.
CPC ..... *B65D 7/24* (2013.01); *B65D 83/0805* (2013.01)

(58) Field of Classification Search
CPC ..... B65D 7/24; B65D 83/0805; B65D 7/12; B65D 9/06; B65D 9/08; B65D 9/12; B65D 83/08; B65D 83/0811; B65D 11/20
See application file for complete search history.

(56) References Cited

U.S. PATENT DOCUMENTS 4,657,176 A * 4/1987 Matsubara ..... B65F 1/00 229/125.32
4,976,355 A * 12/1990 Crutchfield ..... B65F 1/00 229/117
5,257,734 A * 11/1993 Bartle ..... B65D 5/2033 229/109
D527,424 S * 8/2006 Long ..... B65D 77/0446 D19/77
9,561,681 B2 * 2/2017 Magley ..... B42D 15/042
2001/0052477 A1 * 12/2001 McNeill ..... B65D 77/0446 206/459.5
2005/0133387 A1 * 6/2005 Cohen ..... B65D 83/0805 206/449
2012/0074140 A1 * 3/2012 Pittman-Spears ..... A47K 5/12 220/200
2013/0111727 A1 * 5/2013 Eng ..... B60R 7/084 29/428
2014/0021215 A1 * 1/2014 Tran ..... B65H 1/08 221/45
2021/0147164 A1 * 5/2021 Tran ..... B65H 1/08

* cited by examiner

*Primary Examiner* — Kareen K Thomas
(74) *Attorney, Agent, or Firm* — JEEN IP LAW, LLC

(57) ABSTRACT

The invention provides a facial towel packaging box. The facial towel packaging box comprises: an upper cover having an upper wall and first side walls, the first side walls being connected to peripheral edges of the upper wall, and the upper wall and the first side walls defining a first space with an opening; and a lower cover having a lower wall and second side walls, the second side walls being connected to peripheral edges of the lower wall, and the low wall and the second side walls defining a second space with an opening; wherein the first side walls fit into outer sides of the second side walls. The disposable facial towel packaging box provided by the invention makes it more convenient to take out disposable facial towels, and the disposable facial towel packaging box can be reused.

7 Claims, 7 Drawing Sheets

FACIAL TOWEL PACKAGING BOX

TECHNICAL FIELD

The invention relates to the technical field of packaging and storage, in particular to a facial towel packaging box.

BACKGROUND

With the progress of the times, people's demands for the quality of life have become increasingly high. In terms of daily routines like face washing, traditional towels can no longer adapt to the fast pace of life and work of people today.

As the pace of life accelerates, there is a growing desire for more convenient and efficient face washing. Consequently, disposable facial towels have come into play.

Currently, disposable facial towels are stored by cutting them into pieces that can be torn off easily. Once rolled up, they are placed in a plastic bag, allowing users to conveniently take one out whenever needed. Another storage method uses a package similar to a napkin holder, where the disposable facial towels are neatly folded and stored in either a plastic bag or a paper box, allowing for easy access each time one is needed.

However, existing packaging boxes for disposable facial towels have the following technical problems: most disposable facial towels are packaged in plastic bags, which is not environmentally friendly and cannot realize cyclic utilization. This leads to resource waste and poses a threat to the environment. Additionally, it is inconvenient to retrieve disposable facial towels from the packaging box.

SUMMARY

In view of the above technical problems in the prior art, the invention provides a facial towel packaging box, comprising:

an upper cover having an upper wall and first side walls, the first side walls being connected to peripheral edges of the upper wall, and the upper wall and the first side walls defining a first space with an opening; and a lower cover having a lower wall and second side walls, the second side walls being connected to peripheral edges of the lower wall, and the low wall and the second side walls defining a second space with an opening; wherein the first side walls fit the outer sides of the second side walls, or the first side walls fit into inner sides of the second side walls.

The second side walls comprise: a second left side wall; a second right side wall; a second front side wall; and a second rear side wall; the second left side wall, the second right side wall, the second front side wall and the second rear side wall are sequentially connected to form the second side walls; the second left side wall, the second right side wall, the second front side wall and the second rear side wall are all connected to the lower wall; and any one or more of the second left side wall, the second right side wall, the second front side wall and the second rear side wall are provided with open voids. The second left side wall, the second right side wall, the second front side wall or the second rear side wall comprises a first layer and a second layer, and the first layer and the second layer are spaced apart from each other, allowing for an insertion space therebetween. The upper wall is provided with a groove, and a depth of the groove is smaller than a thickness of the upper wall. A seed card is received in the groove, and the seed card comprises: seeds; and a card which houses the seeds, wherein a shape of the card is matched with that of the groove. The facial towel packaging box further comprises a bottom cover having a bottom surface and third side walls, the third side walls are connected to peripheral edges of the bottom surface, the bottom surface is attached to the lower wall, and the third side walls are attached to the outer sides or inner sides of the second side walls. A width of the third side walls is larger than that of the second side walls, and gaps are formed between the third side walls and the second side walls; and hollowed-out areas exist at junctions between the third side walls and the peripheral edges of the bottom surface, and the hollowed-out areas correspond to the gaps in position.

The facial towel packaging box further comprises a mounting plate, and the mounting plate comprises a first wall, a second wall and a bending part. The first wall, the second wall and the bending part are integrally formed, the bending part is connected between the first wall and the second wall, and the first wall or the second wall is inserted into the hollowed-out area. Materials of the upper cover and/or the lower cover comprise: 75%-85% of bagasse, 5%-15% of wood pulp, 3%-8% of bamboo pulp, and 3%-8% of straw fibers.

The invention further provides a facial towel packaging box, which comprises:

an upper cover having an upper wall and first side walls, the first side walls being connected to peripheral edges of the upper wall, and the upper wall and the first side walls defining a first space with an opening; and a lower cover having a lower wall and second side walls, the second side walls being connected to peripheral edges of the lower wall, and the low wall and the second side walls defining a second space with an opening; wherein the first side walls fit into outer sides of the second side walls, or the first side walls fit into the inner sides of the second side walls. The upper cover and the lower cover define a storage space, and facial towels are stored in the storage space; and a manufacturing process of the facial towels comprises: spraying plant essential oil on the facial towels.

The invention further provides a facial towel packaging box, which comprises:

an upper cover having an upper wall and first side walls, the first side walls being connected to peripheral edges of the upper wall, and the upper wall and the first side walls defining a first space with an opening; and a lower cover having a lower wall and second side walls, the second side walls being connected to peripheral edges of the lower wall, and the low wall and the second side walls defining a second space with an opening; wherein the first side walls fit into outer sides of the second side walls, or the first side walls fit into inner sides of the second side walls. The upper cover and the lower cover define a storage space, and facial towels are stored in the storage space; and a manufacturing process of the facial towels comprises: spraying plant essential oil on the facial towels. A manufacturing process of the upper cover and/or the lower cover comprises:

step 1, pulping:

using herbaceous or woody plant fibers as raw materials, crushing the raw materials, adding a waterproof agent, an oil repellent or a wet strength agent, and stirring to form paper pulp;

step 2, molding:

performing suction molding on the paper pulp by using a suction molding machine to form a wet blank, and dewatering and pressing the wet blank to form a dehydrated parison;

step 3, shaping:

transferring the dehydrated parison to a shaping machine for shaping and curing to obtain a semi-finished product; and step 4, die-cutting and disinfection:

die-cutting and disinfecting the semi-finished product to obtain the upper cover and/or the lower cover.

In step 3, hot pressing molding is adopted for shaping and curing the dehydrated parison at a pressure of 1-1.5 MPa and a temperature of 130-150° C.

Vacuum suction molding is adopted for performing suction molding on the paper pulp by using a suction molding machine to form a wet blank in step 2, with a vacuum level of 0.03-0.09 MPa during the suction process.

The invention transforms a traditional disposable facial towel packaging box into a design with an upper cover and a lower cover that are interlocked. By forming the open voids in the lower cover, disposable facial towels can be taken more conveniently and efficiently. Additionally, the selection of materials for the upper cover and the lower cover, along with the design of interlocking between the lower cover, the bottom cover, and the mounting plate, allows the disposable facial towel packaging box to be reused. Furthermore, the disposable facial towel packaging box is made of biodegradable materials, thus meeting environmentally friendly standards.

BRIEF DESCRIPTION OF DRAWINGS

In order to explain the technical solutions in the embodiments of the present invention more clearly, the drawings used in the embodiments will be briefly introduced below. Obviously, the drawings in the following description only illustrate some embodiments of the present invention, and for those of ordinary skill in the art, other drawings can be obtained according to these drawings without paying creative labor.

DESCRIPTION OF EMBODIMENTS

Figure 1:
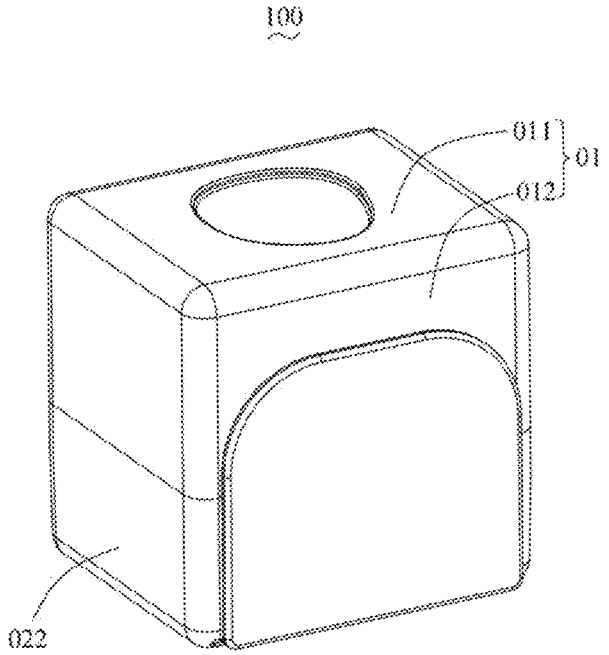
FIG. 1 is a structural diagram of a facial towel packaging box provided by the invention.

The technical solutions in the embodiments of the present invention are clearly and completely described in the following with reference to the drawings in the embodiments of the present invention. It is obvious that the described embodiments are only illustrative ones and are not all possible ones of the present invention. Based on the embodiments of the present invention, all other embodiments obtained by those of ordinary skill in the art without creative labor are within the scope of the present invention.

It should be noted that all directional indications (such as up, down, left, right, front, back, . . . ) in the embodiment of the invention are only used to explain the relative positional relationship, movement situation, etc. among components in a certain posture (as shown in the drawings), and if the specific posture changes, the directional indication will change accordingly.

In addition, in the present invention, descriptions such as "first" and "second" are only used for descriptive purposes, and cannot be understood as indicating or implying relative importance or implicitly indicating the number of indicated technical features. Therefore, a feature defined by "first" and "second" may explicitly or implicitly indicate the inclusion of at least one said feature. In the description of this invention, "multiple" means at least two, such as two, three, etc., unless otherwise specifically defined.

In the present invention, unless otherwise specified and defined, the terms "connect" and "fix" should be understood in a broad sense. For example, "fix" may be fixed connection, detachable connection or integrated connection; it may be mechanical connection or electric connection; and it may be direct connection, indirect connection through intermediate media or internal communication or interaction of two elements, unless otherwise explicitly defined. For those of ordinary skill in the art, the specific meaning of the terms mentioned above in the present invention should be construed to specific circumstances.

In addition, the technical solutions of various embodiments of the present invention can be combined with each other, but these combinations should be able to be implemented by those ordinarily skilled in the art. When the combination of technical solution results in conflicts or becomes unachievable, such a combination of technical schemes should be considered non-existent and not within the scope of protection required by the present invention.

First Embodiment

Figure 2:
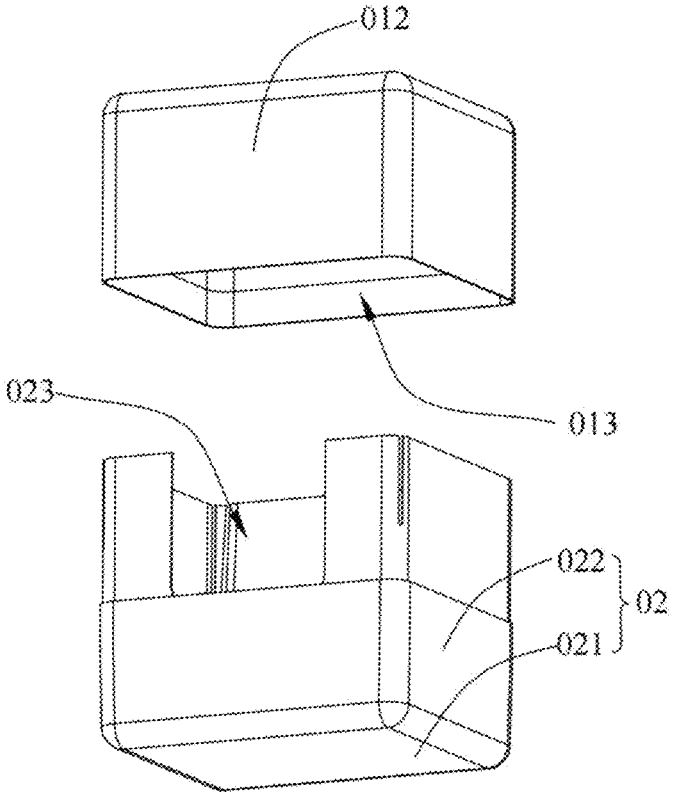
FIG. 2 is an exploded view of a facial towel packaging box provided by the invention.

Referring to FIGS. 1 and 2, FIG. 1 is a structural diagram of a facial towel packaging box provided by the invention, and FIG. 2 is an exploded view of a facial towel packaging box provided by the invention.

The facial towel packaging box 100 comprises:

an upper cover 01, having:

an upper wall 011; and first side walls 012, the first side walls 012 being connected to peripheral edges of the upper wall 011, and the upper wall 011 and the first side walls 012 defining a first space 013 with an opening; and a lower cover 02, having:

a lower wall 021; and second side walls 022, the second side walls 022 being connected to peripheral edges of the lower wall 021, and the low wall 021 and the second side walls 022 defining a second space 023 with an opening;

wherein the first side walls 012 fit into outer sides of the second side walls 022.

In another embodiment provided by the invention, the first side walls 012 fit into inner sides of the second side walls 022.

During use, disposable facial towels are placed in the second space 023 of the lower cover 02. The upper cover 01 can be lifted to place the disposable facial towels into the lower cover 02. The lower cover 02 can be reused, allowing users to purchase only the disposable facial towels for future use and simply place new towels into the lower cover 02. The upper cover 01 can be connected to the second side walls 022 via the first side walls 012, or it can be used for other purposes.

Second Embodiment

Figure 3:
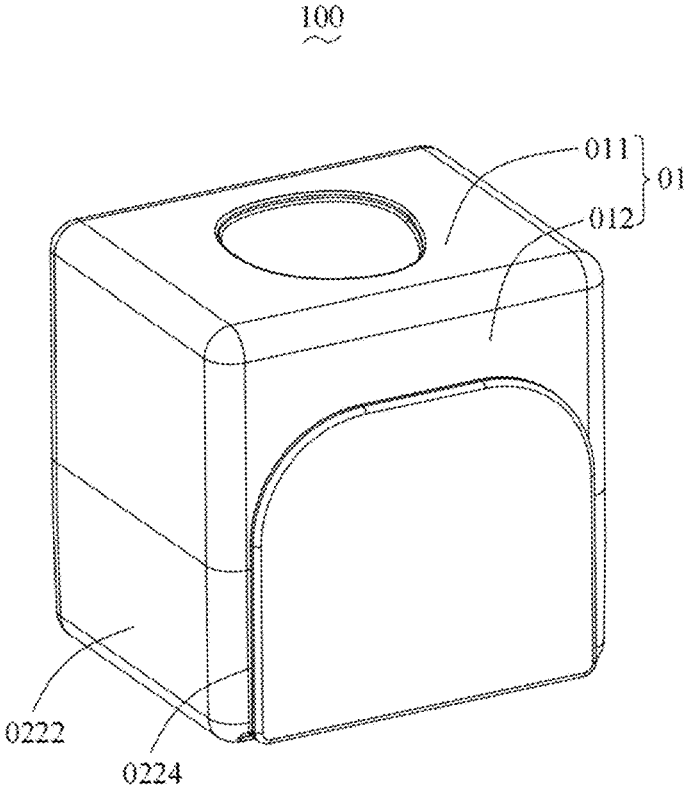
FIG. 3 is a structural diagram of a facial towel packaging box provided by the invention.
Figure 4:
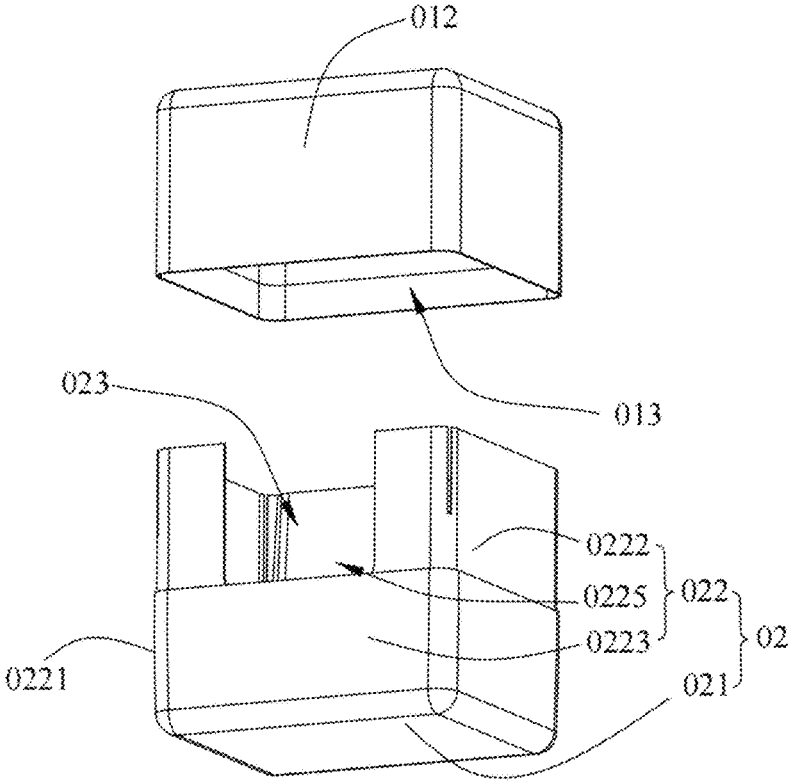
FIG. 4 is an exploded view of a facial towel packaging box provided by the invention.

Referring to FIGS. 3 and 4, FIG. 3 is a structural diagram of a facial towel packaging box provided by the invention, and FIG. 4 is an exploded view of a facial towel packaging box provided by the invention.

The facial towel packaging box 100 comprises:

an upper cover 01, having:

an upper wall 011; and first side walls 012, the first side walls 012 being connected to peripheral edges of the upper wall 011, and the upper wall 011 and the first side walls 012 defining a first space 013 with an opening; and a lower cover 02, having:

a lower wall 021; and second side walls 022, the second side walls 022 being connected to peripheral edges of the lower wall 021, and the low wall 021 and the second side walls 022 defining a second space 023 with an opening;

wherein the first side walls 012 fit into outer sides of the second side walls 022.

The second side walls 022 comprise:

a second left side wall 0221;

a second right side wall 0222;

a second front side wall 0223; and a second rear side wall 0224;

the second left side wall 0221, the second right side wall 0222, the second front side wall 0223 and the second rear side wall 0224 are sequentially connected to form the second side walls 022; the second left side wall 0221, the second right side wall 0222, the second front side wall 0223 and the second rear side wall 0224 are all connected to the lower wall 021; and the second front side wall 0223 is provided with an open void 0225. The open void 0225 is positioned on the upper part of the second front side wall 0223. This design not only provides a fool-proofing function but also makes it easier for people to retrieve the disposable facial towels stored in the second space 023.

Third Embodiment

Figure 5:
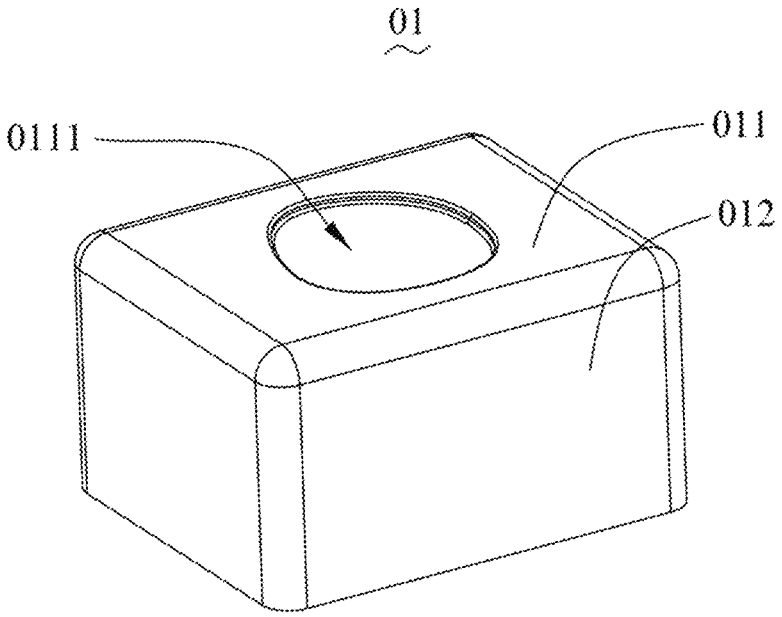
FIG. 5 is a structural diagram of an upper cover 01 of the facial towel packaging box 100 in FIG. 1, from a first perspective.
Figure 6:
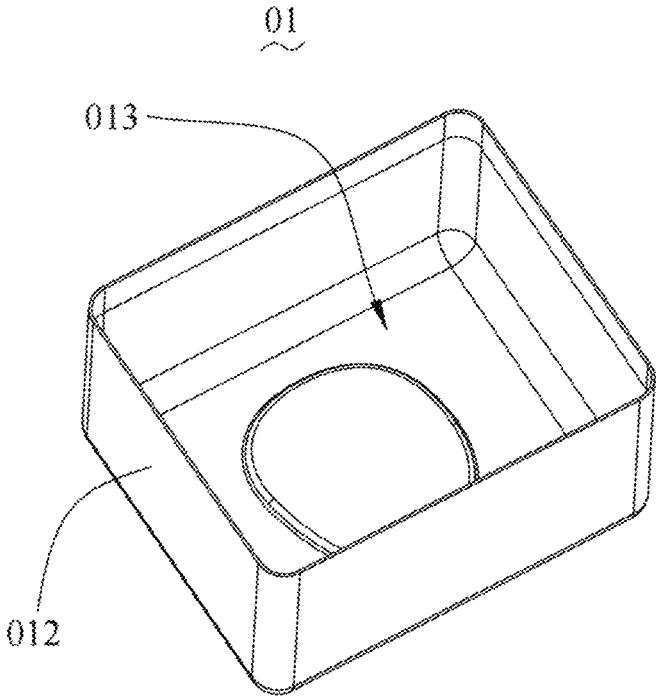
FIG. 6 is a structural diagram of an upper cover 01 of the facial towel packaging box 100 in FIG. 1, from a second perspective.

Referring to FIGS. 5 and 6, FIG. 5 is a structural diagram of an upper cover 01 of the facial towel packaging box 100 in FIG. 1, from a first perspective, and FIG. 6 is a structural diagram of the upper cover 01 in FIG. 1, from a second perspective.

As shown in the figures, the upper cover 01 comprises an upper wall 011 and first side walls 012.

The first side walls 012 are connected to peripheral edges of the upper wall 011, and the upper wall 011 and the first side walls 012 define a first space 013 with an opening. The upper wall 011 is provided with a groove 0111, and a depth of the groove 0111 is smaller than a thickness of the upper wall 011. The groove 0111 may be designed in various shapes, such as heart-shaped, square, or circular. The groove 0111 may hold other items, while allowing consumers to easily identify the top and bottom of the facial towel packaging box 100 during use, preventing them from mistakenly using it upside down.

Fourth Embodiment

Figure 7:
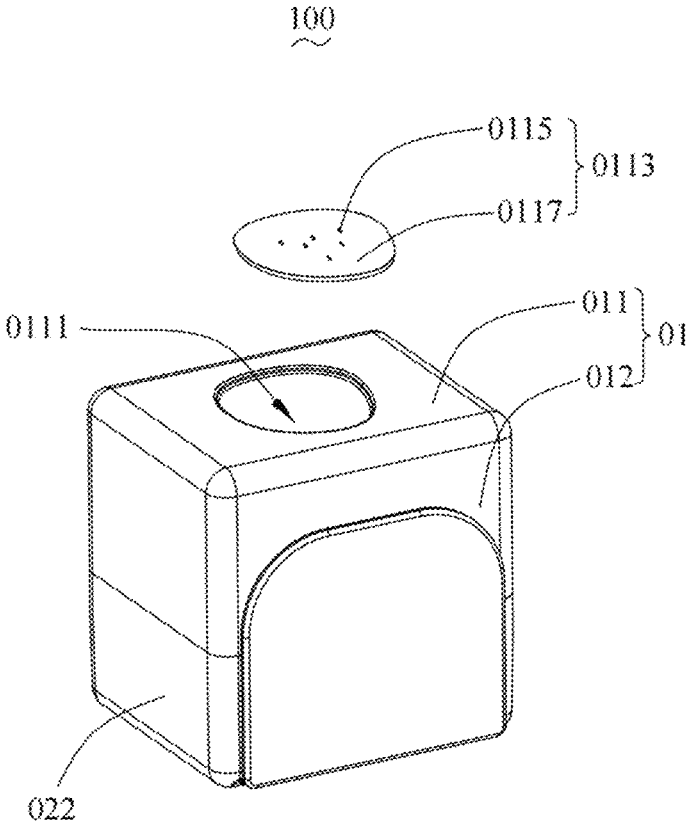
FIG. 7 is a structural diagram of a facial towel packaging box provided by the invention.
Figure 8:
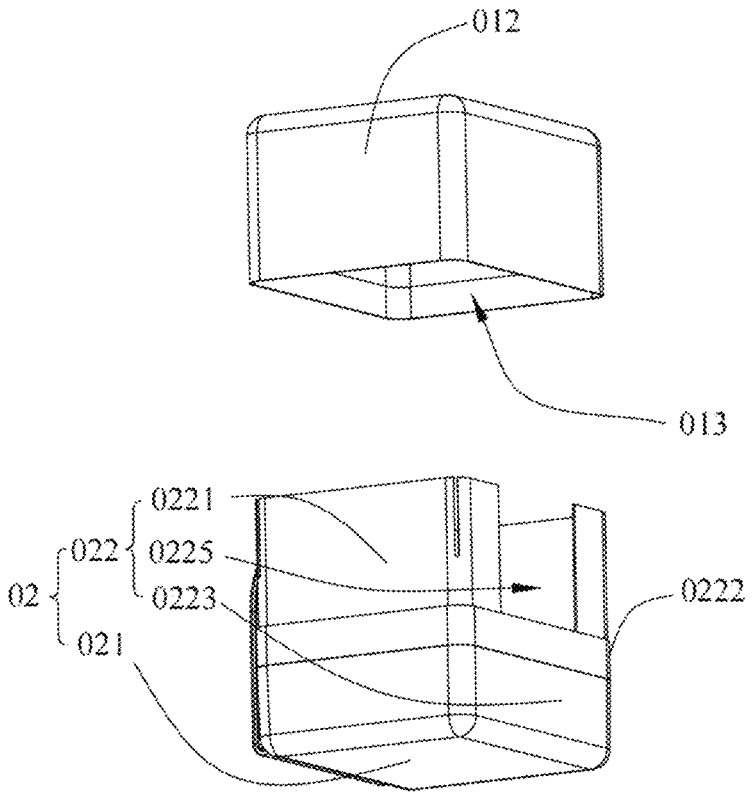
FIG. 8 is an exploded view of a facial towel packaging box provided by the invention.

Referring to FIGS. 7 and 8, FIG. 7 is a structural diagram of a facial towel packaging box provided by the invention, and FIG. 8 is an exploded view of a facial towel packaging box provided by the invention.

The facial towel packaging box 100 comprises:

an upper cover 01, having:

an upper wall 011; and first side walls 012, the first side walls 012 being connected to peripheral edges of the upper wall 011, and the upper wall 011 and the first side walls 012 defining a first space 013 with an opening; and a lower cover 02, having:

a lower wall 021; and second side walls 022, the second side walls 022 being connected to peripheral edges of the lower wall 021, and the low wall 021 and the second side walls 022 defining a second space 023 with an opening;

wherein the first side walls 012 fit into outer sides of the second side walls 022.

In another embodiment provided by the invention, the first side walls 012 fit into the inner sides of the second side walls 022.

The second side walls 022 comprise:

a second left side wall 0221;

a second right side wall 0222;

a second front side wall 0223; and a second rear side wall 0224;

the second left side wall 0221, the second right side wall 0222, the second front side wall 0223 and the second rear side wall 0224 are sequentially connected to form the second side walls 022; the second left side wall 0221, the second right side wall 0222, the second front side wall 0223 and the second rear side wall 0224 are all connected to the lower wall 021; and the second front side wall 0223 is provided with an open void 0225. The open void 0225 is positioned on the upper part of the second front side wall 0223. This design not only provides a fool-proofing function but also makes it easier for people to retrieve the disposable facial towels stored in the second space 023.

The upper cover 01 comprises an upper wall 011 and first side walls 012.

The first side walls 012 are connected to peripheral edges of the upper wall 011, and the upper wall 011 and the first side walls 012 define a first space 013 with an opening. The upper wall 011 is provided with a groove 0111, and a depth of the groove 0111 is smaller than a thickness of the upper wall 011. The groove 0111 is square.

A seed card 0113 is received in the groove 0111, and the seed card comprises: seeds 0115; and a card 0117 which houses the seeds 0115, wherein a shape of the card 0117 is matched with that of the groove 0111.

The groove 0111 houses the seed card 0113, meeting environmental protection requirements. Typically, during use, consumers may take the seeds 0115 out of the seed card 0113 and plant them.

Fifth Embodiment

Figure 9:
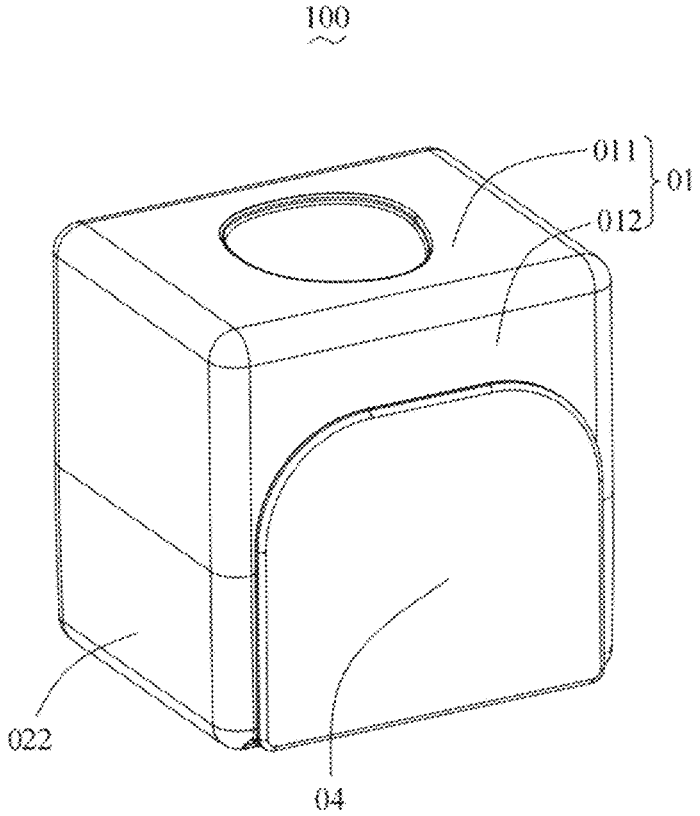
FIG. 9 is a structural diagram of a facial towel packaging box provided by the invention.
Figure 10:
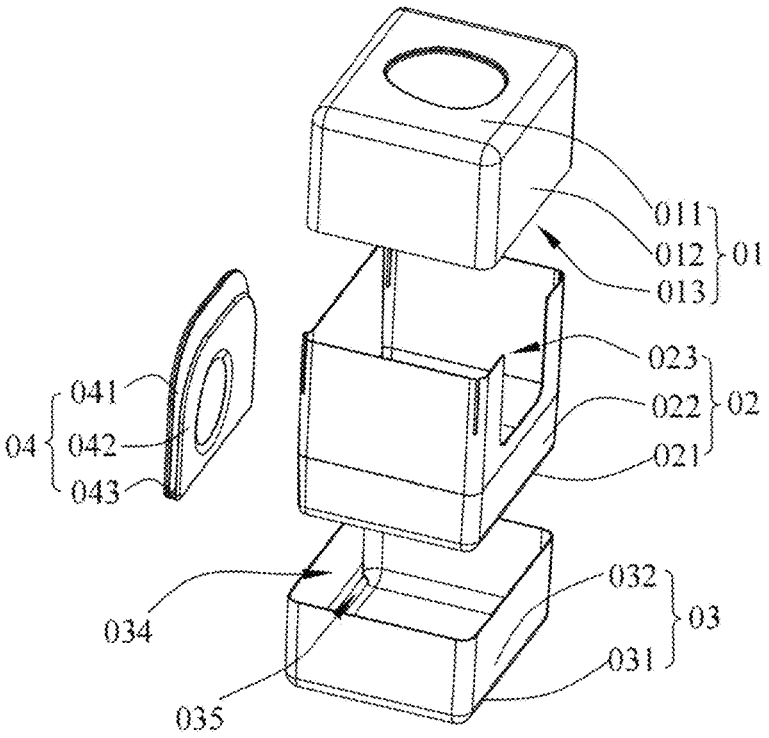
FIG. 10 is an exploded view of a facial towel packaging box provided by the invention.
Figure 11:
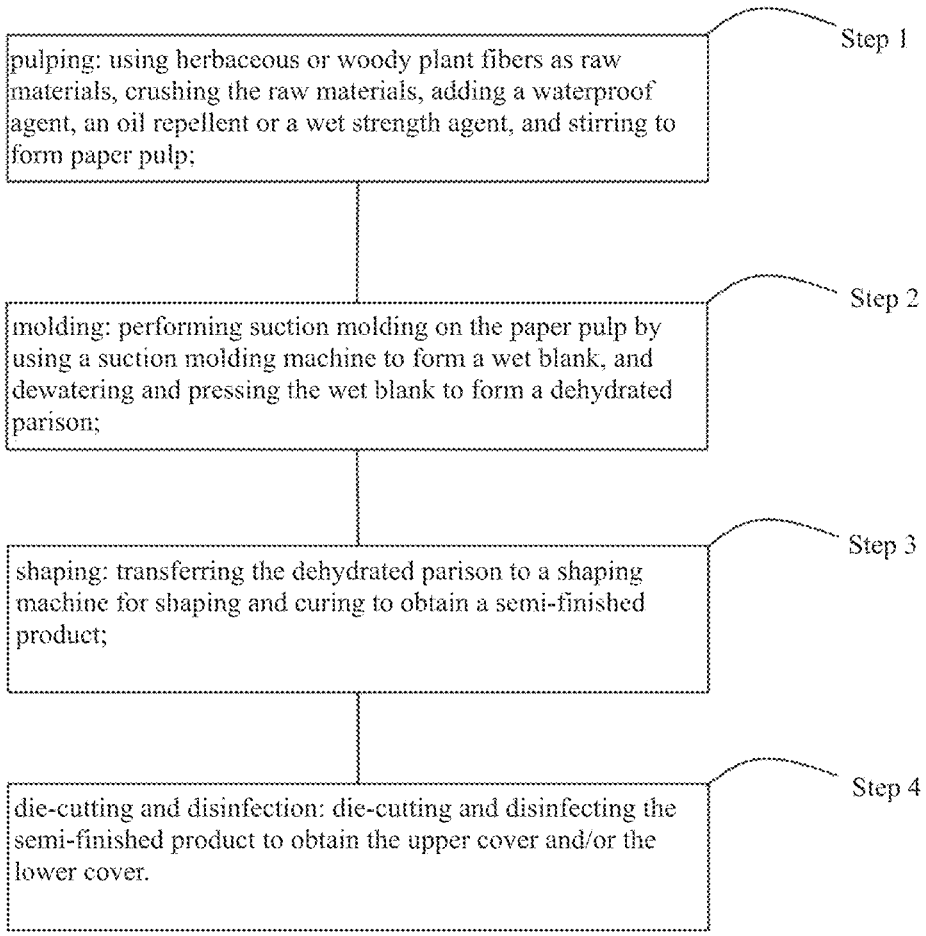
FIG. 11 is a diagram of a manufacturing process of a facial towel packaging box 100 provided by the invention.

Referring to FIGS. 9 and 10, FIG. 9 is a structural diagram of a facial towel packaging box provided by the invention, and FIG. 10 is an exploded view of a facial towel packaging box provided by the invention.

The facial towel packaging box 100 comprises:

an upper cover 01, having an upper wall 011 and first side walls 012, the first side walls 012 being connected to peripheral edges of the upper wall 011, and the upper wall 011 and the first side walls 012 defining a first space 013 with an opening; and a lower cover 02, having a lower wall 021 and second side walls 022, the second side walls 022 being connected to peripheral edges of the lower wall 021, and the low wall 021 and the second side walls 022 defining a second space 023 with an opening;

wherein the first side walls 012 fit into outer sides of the second side walls 022.

In another embodiment provided by the invention, the first side walls 012 fit into the inner sides of the second side walls 022.

During use, disposable facial towels are placed in the second space 023 of the lower cover 02. The upper cover 01 can be lifted to place the disposable facial towels into the lower cover 02. The lower cover 02 can be reused, allowing users to purchase only the disposable facial towels for future use and simply place new towels into the lower cover 02. The upper cover 01 can be connected to the second side walls 022 via the first side walls 012, or it can be used for other purposes.

The facial towel packaging box further comprises a bottom cover 03 having a bottom surface 031 and third side walls 032, the third side walls 032 are connected to peripheral edges of the bottom surface 031, the bottom surface 031 is attached to the lower wall 021, and the third side walls 032 are attached to the outer sides or inner sides of the second side walls 022.

A width of the third side walls 032 is larger than that of the second side walls 022, and gaps 034 are formed between the third side walls 032 and the second side walls 022; and hollowed-out areas 035 exist at junctions between the third side walls 032 and the peripheral edges of the bottom surface 031, and the hollowed-out areas 035 correspond to the gaps 034 in position.

The facial towel packaging box further comprises a mounting plate 04, and the mounting plate 04 comprises a first wall 041, a second wall 042 and a bending part 043.

The first wall 041, the second wall 042 and the bending part 043 are integrally formed, the bending part 043 is connected between the first wall 041 and the second wall 042, and the first wall 041 or the second wall 042 is inserted into the hollowed-out area 035.

It should be noted that the mounting plate 04 is generally made of plastic and can be attached to a wall. The facial towel packaging box 100 can then be secured to the mounting plate 04 through the first wall 041 or the second wall 042. In practice, the mounting plate 04 can be reused, and the facial towel packaging box 100 can be replaced as needed.

It should be noted that in the embodiment of the invention, materials of the facial towel packaging box 100 comprise: 75%-85% of bagasse, 5%-15% of wood pulp, 3%-8% of bamboo pulp, and 3%-8% of straw fibers.

The materials mentioned above are all biodegradable and environmentally friendly, meaning that even they will not pollute the environment even in a case of replacement. Furthermore, in setting the ratios of the materials, the invention distinguishes itself from existing disposable facial towel packaging boxes by using bagasse as the largest component. Most existing disposable facial towel packaging boxes primarily use wood pulp, however, such traditional packaging is not readily degradable. By setting bagasse as the predominant component, the present invention increases the biodegradability of the disposable facial towel packaging box, making it more environmentally friendly.

In another specific embodiment of the invention, a manufacturing process of the disposable facial towels comprises: spraying plant essential oil on the facial towels. Spraying plant essential oil onto the disposable facial towels increases their acceptability among average consumers.

It should be noted that the spraying method may be sprinkling, smearing, soaking, or other techniques.

Refer to FIG. 10 which is a diagram of a manufacturing process of a facial towel packaging box 100 provided by the invention.

The manufacturing process comprises:

step 1, pulping:

using herbaceous or woody plant fibers as raw materials, crushing the raw materials, adding a waterproof agent, an oil repellent or a wet strength agent, and stirring to form paper pulp;

step 2, molding:

performing suction molding on the paper pulp by using a suction molding machine to form a wet blank, and dewatering and pressing the wet blank to form a dehydrated parison;

step 3, shaping:

transferring the dehydrated parison to a shaping machine for shaping and curing to obtain a semi-finished product; and step 4, die-cutting and disinfection:

die-cutting and disinfecting the semi-finished product to obtain the upper cover and/or the lower cover.

It should be noted that in the invention, the "herbaceous or woody plant fibers" in step 1 refer to a mixture of bagasse, wood pulp, bamboo pulp, and straw fibers, with the following proportions: 75%-85% of bagasse, 5%-15% of wood pulp, 3%-8% of bamboo pulp, and 3%-8% of straw fibers.

It should be noted that in step 3, hot pressing molding is adopted for shaping and curing the dehydrated parison at a pressure of 1-1.5 MPa and a temperature of 130-150° C.

It should be noted that vacuum suction molding is adopted for performing suction molding on the paper pulp by using a suction molding machine to form a wet blank in step 2, with a vacuum level of 0.03-0.09 MPa during the suction process.

The above are only embodiments of the present invention, which do not limit the patent scope of the present invention. Any equivalent structures or equivalent flow transformations made by using the contents of the specification and drawings of the present invention, or directly or indirectly applications to other related technical fields, are equally included in the patent protection scope of the present invention.

What is claimed is:

1. A facial towel packaging box, comprising:

an upper cover, having:

an upper wall; and first side walls, the first side walls being connected to peripheral edges of the upper wall, and the upper wall and the first side walls defining a first space with an opening; and a lower cover, having:

a lower wall; and second side walls, the second side walls being connected to peripheral edges of the lower wall, and the low wall and the second side walls defining a second space with an opening;

wherein the first side walls are interference fit with outer sides of the second side walls, or the first side walls are interference fit with inner sides of the second side walls;

wherein the upper wall is provided with a groove, and a depth of the groove is smaller than a thickness of the upper wall;

wherein a seed card is received in the groove, and the seed card comprises:

seeds; and a card which houses the seeds, wherein a shape of the card is matched with that of the groove.

2. The facial towel packaging box according to claim 1, wherein the second side walls comprise:

a second left side wall;

a second right side wall;

a second front side wall; and a second rear side wall;

the second left side wall, the second right side wall, the second front side wall and the second rear side wall are sequentially connected to form the second side walls; the second left side wall, the second right side wall, the second front side wall and the second rear side wall are all connected to the lower wall; and any one or more of the second left side wall, the second right side wall, the second front side wall and the second rear side wall are provided with open voids.

3. The facial towel packaging box according to claim 1, wherein the second side walls comprise:

a second left side wall;

a second right side wall;

a second front side wall; and a second rear side wall;

the second left side wall, the second right side wall, the second front side wall and the second rear side wall are sequentially connected to form the second side walls; the second left side wall, the second right side wall, the second front side wall and the second rear side wall are all connected to the lower wall; and the second left side wall, the second right side wall, the second front side wall or the second rear side wall comprises a first layer and a second layer, and the first layer and the second layer are spaced apart from each other, allowing for an insertion space therebetween.

4. The facial towel packaging box according to claim 1, further comprising:

a bottom cover, having:

a bottom surface; and third side walls connected to peripheral edges of the bottom surface;

wherein the bottom surface is attached to the lower wall, and the third side walls are attached to the outer sides or inner sides of the second side walls.

5. The facial towel packaging box according to claim 4, wherein a width of the third side walls is larger than that of the second side walls, and gaps are formed between the third side walls and the second side walls; and hollowed-out areas exist at junctions between the third side walls and the peripheral edges of the bottom surface, and the hollowed-out areas correspond to the gaps in position.

6. The facial towel packaging box according to claim 4, further comprising a mounting plate, wherein the mounting plate comprises:

a first wall;

a second wall; and a bending part;

the first wall, the second wall and the bending part are integrally formed, and the bending part is connected between the first wall and the second wall;

the first wall or the second wall is inserted into the hollowed-out area.

7. The facial towel packaging box according to claim 1, wherein materials of the upper cover and/or the lower cover comprise:

75%-85% of bagasse, 5%-15% of wood pulp, 3%-8% of bamboo pulp, and 3%-8% of straw fibers.

* * * * *